US006785656B2

(12) United States Patent
Patsiokas et al.

(10) Patent No.: US 6,785,656 B2
(45) Date of Patent: Aug. 31, 2004

(54) METHOD AND APPARATUS FOR DIGITAL AUDIO PLAYBACK USING LOCAL STORED CONTENT

(75) Inventors: Stelios Patsiokas, Coral Springs, FL (US); Paul Marko, Pembroke Pines, FL (US); Craig Wadin, Sunrise, FL (US)

(73) Assignee: XM Satellite Radio, Inc., Washington, DC (US)

( * ) Notice: Subject to any disclaimer, the term of this patent is extended or adjusted under 35 U.S.C. 154(b) by 363 days.

(21) Appl. No.: 09/874,741

(22) Filed: Jun. 5, 2001

(65) Prior Publication Data

US 2002/0184037 A1 Dec. 5, 2002

(51) Int. Cl.[7] ..... G10L 19/00

(52) U.S. Cl. ..... 704/500; 704/201; 455/3.02; 455/161.2; 455/186.1; 375/130; 370/326

(58) Field of Search ..... 704/500, 201; 455/3.02, 161.2, 186.1; 375/130; 370/326

(56) References Cited

U.S. PATENT DOCUMENTS

| | | | | | |
|---|---|---|---|---|---|
| 4,215,370 | A | * | 7/1980 | Kirk, Jr. | 375/240.01 |
| 5,018,136 | A | * | 5/1991 | Gollub | 370/471 |
| 5,283,780 | A | * | 2/1994 | Schuchman | 370/312 |
| 5,406,558 | A | * | 4/1995 | Rovira | 370/326 |
| 5,524,051 | A | * | 6/1996 | Ryan | 380/237 |
| 5,548,828 | A | * | 8/1996 | Kozaki | 455/161.2 |
| 5,592,471 | A | * | 1/1997 | Briskman | 455/506 |
| 5,612,729 | A | | 3/1997 | Ellis et al. | |
| 5,655,058 | A | | 8/1997 | Balasubramanian et al. | |
| 5,712,953 | A | | 1/1998 | Langs | |
| 5,864,579 | A | * | 1/1999 | Briskman | 375/130 |
| 5,878,135 | A | * | 3/1999 | Blatter | 380/239 |
| 6,038,434 | A | * | 3/2000 | Miyake | 455/186.1 |
| 6,129,340 | A | | 10/2000 | Abecassis | |
| 6,185,527 | B1 | | 2/2001 | Petkovic et al. | |
| 6,347,216 | B1 | * | 2/2002 | Marko et al. | 455/12.1 |
| 2001/0005900 | A1 | * | 6/2001 | Yoshida | 725/35 |
| 2001/0028782 | A1 | * | 10/2001 | Ohno | 386/46 |
| 2002/0071658 | A1 | * | 6/2002 | Marko et al. | 386/70 |

* cited by examiner

*Primary Examiner*—Vijay Chawan
(74) *Attorney, Agent, or Firm*—Akerman Senterfitt

(57) ABSTRACT

A device (100) for receiving, storing and playing back digital audio radio signals comprises a receiver (203), a decoder (502 and/or 504), a user input (516), a storage medium (510) coupled to the decoder, and a system controller (508) coupled to the user input. The receiver receives a digitally encoded bit stream (300) on a plurality of communication resources (104), wherein each communication resource contains content and associated index information. The decoder selectively decodes a selected plurality of communication resources and the user input selects the selected plurality based on the associated index information and selects a portion of the content contained in selected plurality to be retrieved. The storage medium stores the content and associated index information contained in the selected plurality of communication resources and the system controller stores and retrieves content to and from the storage medium based on input received at the user input.

16 Claims, 3 Drawing Sheets

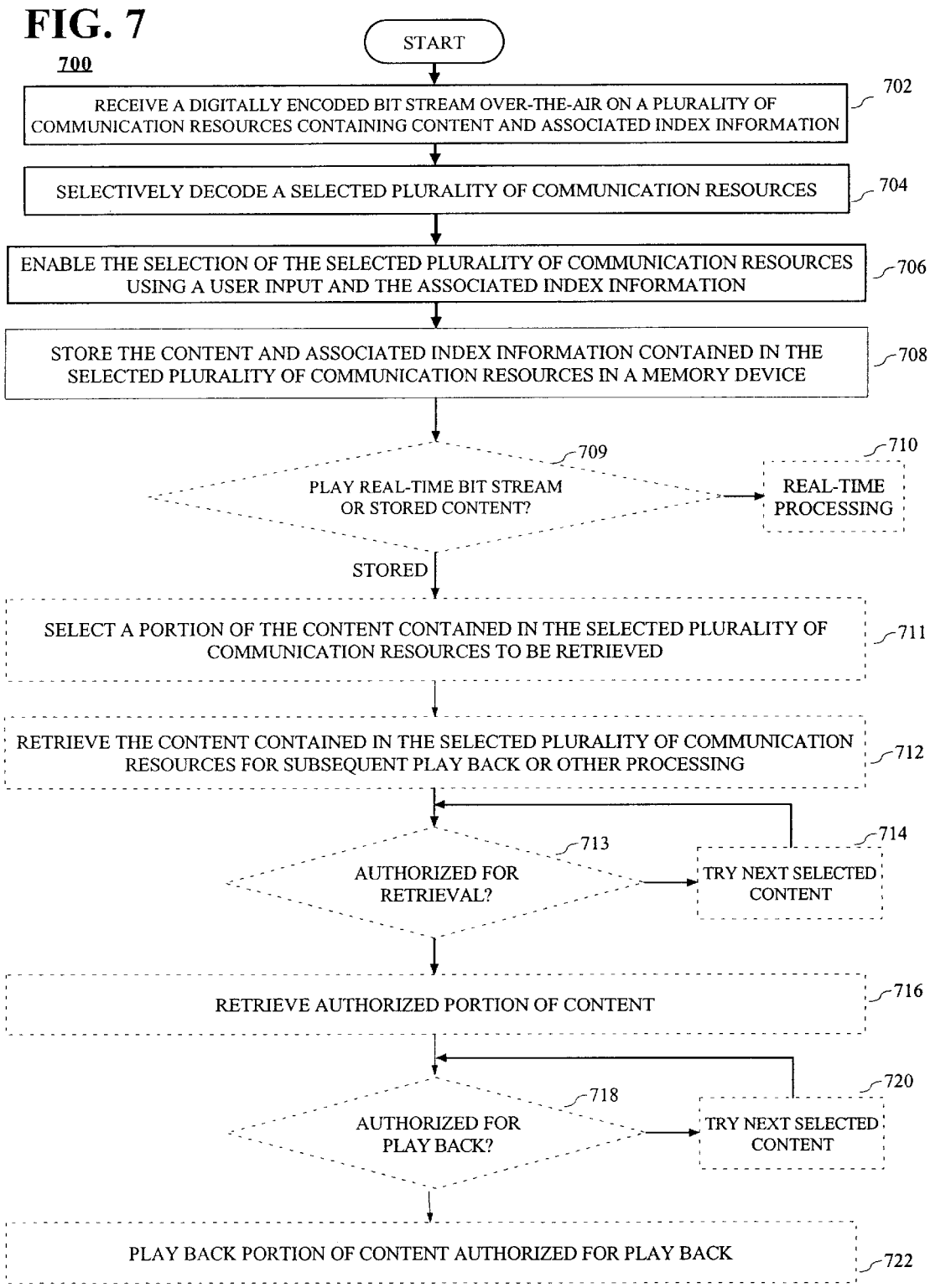
FIG. 7
700
START
RECEIVE A DIGITALLY ENCODED BIT STREAM OVER-THE-AIR ON A PLURALITY OF COMMUNICATION RESOURCES CONTAINING CONTENT AND ASSOCIATED INDEX INFORMATION
702
SELECTIVELY DECODE A SELECTED PLURALITY OF COMMUNICATION RESOURCES
704
ENABLE THE SELECTION OF THE SELECTED PLURALITY OF COMMUNICATION RESOURCES USING A USER INPUT AND THE ASSOCIATED INDEX INFORMATION
706
STORE THE CONTENT AND ASSOCIATED INDEX INFORMATION CONTAINED IN THE SELECTED PLURALITY OF COMMUNICATION RESOURCES IN A MEMORY DEVICE
708
PLAY REAL-TIME BIT STREAM OR STORED CONTENT?
709
REAL-TIME PROCESSING
710
STORED
SELECT A PORTION OF THE CONTENT CONTAINED IN THE SELECTED PLURALITY OF COMMUNICATION RESOURCES TO BE RETRIEVED
711
RETRIEVE THE CONTENT CONTAINED IN THE SELECTED PLURALITY OF COMMUNICATION RESOURCES FOR SUBSEQUENT PLAY BACK OR OTHER PROCESSING
712
AUTHORIZED FOR RETRIEVAL?
713
TRY NEXT SELECTED CONTENT
714
RETRIEVE AUTHORIZED PORTION OF CONTENT
716
AUTHORIZED FOR PLAY BACK?
718
TRY NEXT SELECTED CONTENT
720
PLAY BACK PORTION OF CONTENT AUTHORIZED FOR PLAY BACK
722

METHOD AND APPARATUS FOR DIGITAL AUDIO PLAYBACK USING LOCAL STORED CONTENT

CROSS-REFERENCE TO RELATED APPLICATIONS (not applicable)

FIELD OF THE INVENTION

The invention relates generally to a method and apparatus for storing and playing back digital audio radio signals, and more particularly to a method and apparatus for enabling non-real time as well as real time playback of digital audio radio signals.

BACKGROUND OF THE INVENTION

Satellite radio operators will soon provide digital quality radio broadcast services covering the entire continental United States. These services will offer approximately 100 channels, of which nearly 50 channels in a typical configuration will provide music with the remaining stations offering news, sports, talk and data channels. Digital radio may also be available in the near future from conventional analog radio broadcasters that will provide a terrestrial based system using signals colocated in the AM and FM bands.

Satellite radio has the ability to improve terrestrial radio's potential by offering a better audio quality, greater coverage and fewer commercials. Accordingly, in October of 1997, the Federal Communications Commission (FCC) granted two national satellite radio broadcast licenses. The FCC allocated 25 megahertz (MHZ) of the electromagnetic spectrum for satellite digital broadcasting, 12.5 MHz of which are owned by Sirius Satellite Radio and 12.5 MHz of which are owned by the assignee of the present application "XM Satellite Radio Inc."

The system plan for each licensee presently includes transmission of substantially the same program content from two or more geosynchronous or geostationary satellites to both mobile and fixed receivers on the ground. In urban canyons and other high population density areas with limited line-of-sight (LOS) satellite coverage, terrestrial repeaters will broadcast the same program content in order to improve coverage reliability. Some mobile receivers will be capable of simultaneously receiving signals from two satellites and one terrestrial repeater for combined spatial, frequency and time diversity, which provides significant mitigation of multipath interference and addresses reception issues associated with blockage of the satellite signals.

In accordance with XM Satellite Radio's unique scheme, the 12.5 MHZ band will be split into 6 slots. Four slots will be used for satellite transmission. The remaining two slots will be used for terrestrial reinforcement.

In accordance with the XM frequency plan, each of two geostationary satellites will transmit identical or at least similar program content. The signals transmitted with QPSK modulation from each satellite (hereinafter satellite 1 and satellite 2. For reliable reception, the LOS signals transmitted from satellite 1 are received, reformatted to Multi-Carrier Modulation (MCM) and rebroadcast by terrestrial repeaters. The assigned 12.5 MHZ bandwidth (hereinafter the "XM" band) is partitioned into two equal ensembles or program groups A and B. Each ensemble will be transmitted by each satellite on a separate radio frequency (RF) carrier. Each RF carrier supports up to 50 channels of music or data in Time Division Multiplex (TDM) format.

Thus, in a system as described above, a need exists for a device that receives, stores, and plays back digital audio radio signals in a manner that provides the user flexibility and ease of use in choosing between and among various content selections whether such content is live or previously stored. A need further exists for a device that gives the user flexibility in selecting, storing and playing back selections based on the type of content or other user preferences.

SUMMARY OF THE INVENTION

In a first aspect of the present invention, a device for receiving, storing and playing back digital audio radio signals comprises a receiver, a decoder, a user input, a storage medium coupled to the decoder, and a system controller coupled to the user input. The receiver receives a digitally encoded bit stream over-the-air on a plurality of communication resources, wherein each of the plurality of communication resources contains content and associated index information. The decoder selectively decodes a selected plurality of communication resources and the user input selects the selected plurality of communication resources based on the associated index information and selects a portion of the content contained in selected plurality of communication resources to be retrieved. The storage medium stores the content and associated index information contained in the selected plurality of communication resources and the system controller stores and retrieves content to and from the storage medium based on input received at the user input.

In another aspect of the present invention, a method of receiving and storing digital audio radio signals, comprises the steps of receiving a digitally encoded bit stream over-the-air on a plurality of communication resources, wherein each of the plurality of communication resources contains content and associated index information and selectively decoding a selected plurality of communication resources. The method then enables the selection of the selected plurality of communication resources using a user input and the associated index information and stores the content and associated index information contained in the selected plurality of communication resources in a memory device.

In a third aspect of the present invention, a system for transmitting, receiving, storing and playing back digital audio radio signals comprises an encoder, a transmitter, a receiver, a decoder, a user input, a storage medium coupled to the decoder, and a system controller coupled to the user input. The encoder encodes a plurality of content sources and associated index information in a digitally encoded bit stream and the transmitter transmits over-the-air the plurality of content sources on a corresponding plurality of communication resources. The receiver receives the digitally encoded bit stream over-the-air on the plurality of communication resources and the decoder selectively decodes a selected plurality of communication resources. The user input selects the selected plurality of communication resources based on the associated index information and selects a portion of the content contained in selected plurality of communication resources to be retrieved. The storage medium stores the content and associated index information contained in the selected plurality of communication resources and the system controller stores and retrieves content to and from the storage medium based on input received at the user input interface.

BRIEF DESCRIPTION OF THE DRAWINGS

FIG. 7 is a flowchart illustrating a method in accordance with the present invention.

DETAILED DESCRIPTION OF THE DRAWINGS

Figure 1:
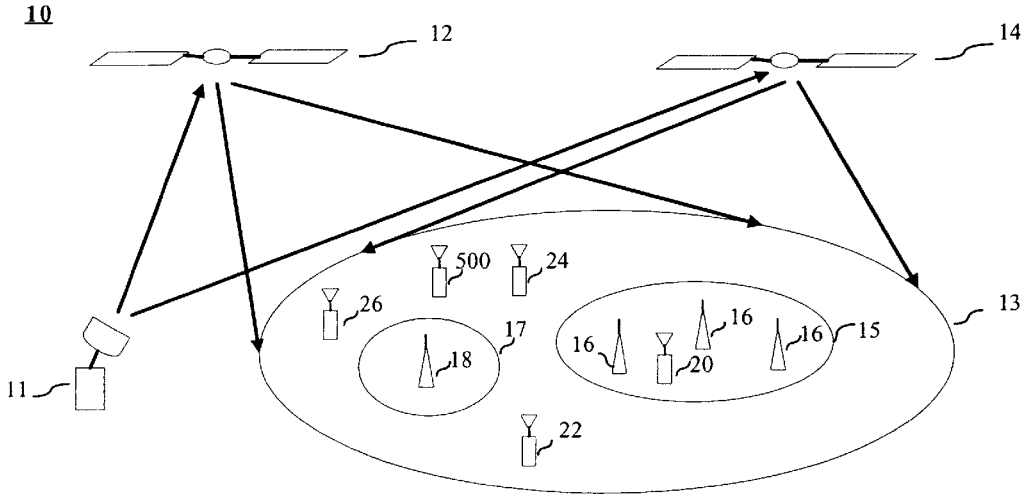
FIG. 1 illustrates a Satellite digital audio radio service system architecture in accordance with the present invention.

Referring to FIG. 1, satellite radio operators will soon provide digital radio service to the continental United States. Briefly, the service provided by XM Satellite Radio includes a satellite X-band uplink 11 to two satellites (12 and 14) which provide frequency translation to the S-band for re-transmission to radio receivers (500, 20, 22, 24, and 26) on earth within the coverage area 13. Radio frequency carriers from one of the satellites are also received by terrestrial repeaters (16 and 18). The content received at the repeaters is retransmitted at a different S-band carrier to the same radios (20) that are within their respective coverage areas (15 and 17). These terrestrial repeaters facilitate reliable reception in geographic areas where LOS reception from the satellites is obscured by tall buildings, hills, tunnels and other obstructions. The signals transmitted by the satellites 12 and 14 and the repeaters are received by SDARS receivers 20–26. As depicted in FIG. 1, the receivers 20–26 may be located in automobiles, handheld or stationary units for home or office use. The SDARS receivers 20–26 are designed to receive one or both of the satellite signals and the signals from the terrestrial repeaters and combine or select one of the signals as the receiver output.

Figure 2:
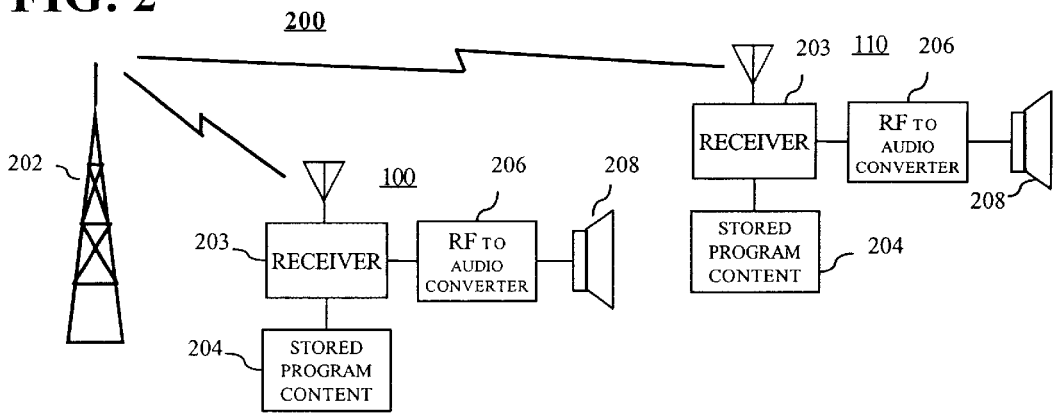
FIG. 2 is a block diagram illustrating a terrestrial based digital audio radio service system architecture in accordance with the present invention.

Referring to FIG. 2, a terrestrial based radio communication system 200 is shown in accordance with present invention. The system 200 preferably comprises a transmission station 202 that transmits signals similar to the repeater stations described above or alternatively could be other transmission formats such as FM, or other modulation techniques suitable for transmission of digital audio. The system 200 also preferably includes a plurality of receiver units (100 and 110 for example) each preferably having a receiver 203, stored program content in storage media 204, and a radio frequency to audio converter 206 for playing audio via speaker 208.

Figure 3:
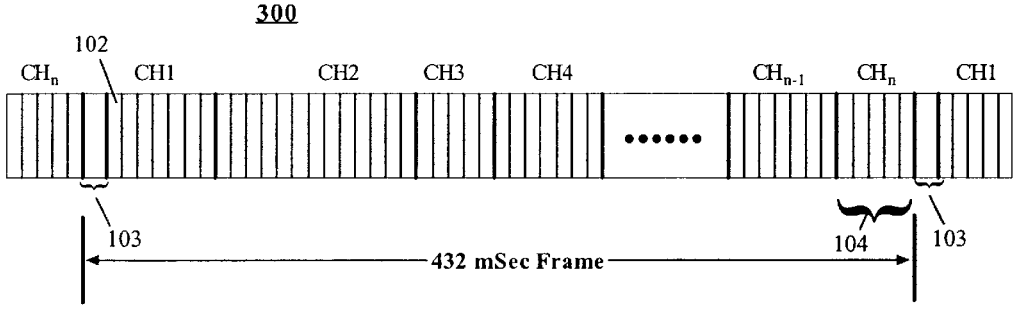
FIG. 3 is a diagram illustrating a representative bit stream in a frame format for distributing data in accordance with the present invention.

Referring to FIG. 3, a plurality of communication resource channels (Channel 1 through n) are shown in accordance with the present invention. In this instance, the over-the-air protocol frame format 300 of the XM Satellite Radio system is shown. This frame format 300 is based on a 432 millisecond frame as shown in FIG. 3 where each frame is subdivided into 8 kilobit per second sub-channels 102. These sub-channels 102 can be dynamically grouped to form higher bit rate payload channels 104. The payload channel or communication resource 104 provides the necessary bandwidth to transport a high-quality digital audio signal to the listener as well as other data as will become more apparent. When a listener changes channels, a receiver in accordance with the present invention simply extracts a different payload channel from the frame 300. It should be noted that each receiver in the XM Satellite System has a unique identifier allowing for the capability of individually addressing each receiver over-the-air to enable or disable services or to provide custom applications such as individual data services or group data services.

Figure 4:
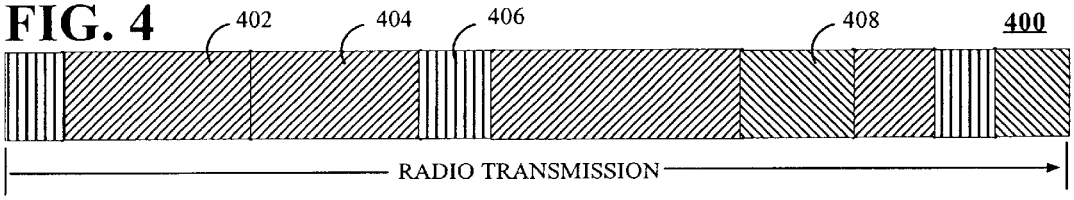
FIG. 4 is another diagram illustrating a typical live radio broadcast transmission in accordance with the present invention.

Referring to FIG. 4, an illustration of a typical live radio broadcast transmission 400 is shown composed various content segments representing music (in segments 402 and 404), live talk (segment 406), and information (segment 408) as examples.

Figure 5:
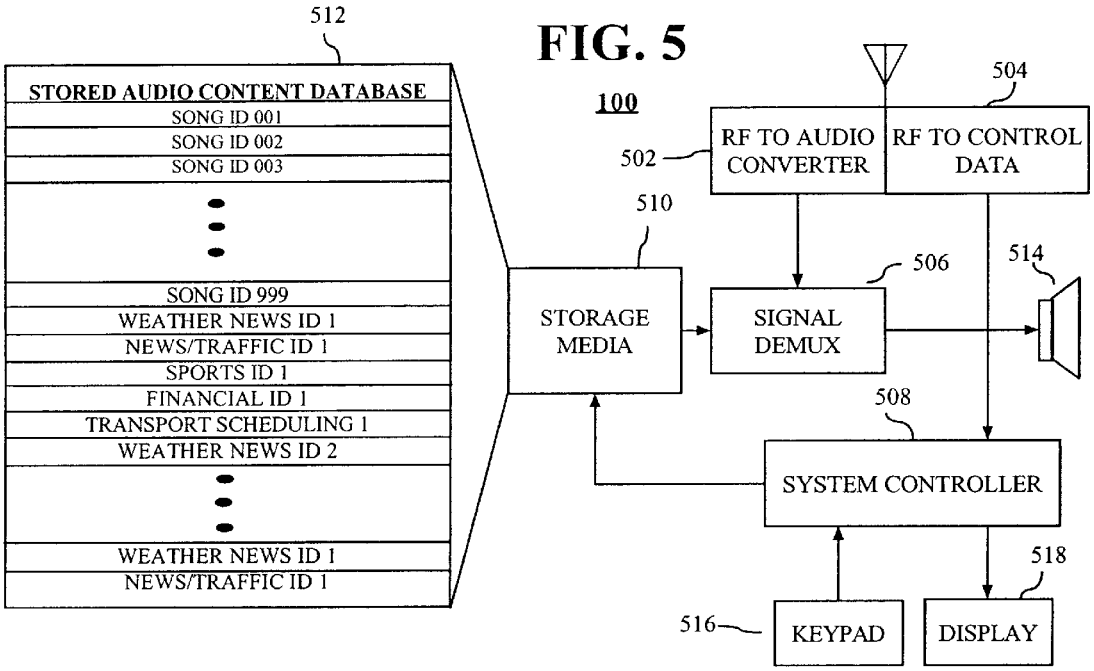
FIG. 5 is a block diagram of a radio receiver unit with storage media in accordance with the present invention.

Referring to FIG. 5, a block diagram of a typical subscriber radio or receiver unit 500 in accordance with the present invention is shown. The receiver unit 500 preferably comprises local storage media 510 having multiple content segments that have been targeted for storage by the user using associated index information. The storage media 510 preferably contains a stored audio content database 512 that is accessible using the associated index information. The RF to audio block converter 502 provides access to the real-time over the air content segments. The RF to control data block 504 enables a system controller 508 with the control data required to control a signal demultiplexer block 506 for selecting either real time content segments or locally stored content segments for routing to the user, either visually through a display 518 or audibly through an audio output device 514 such as a speaker.

Figure 6:
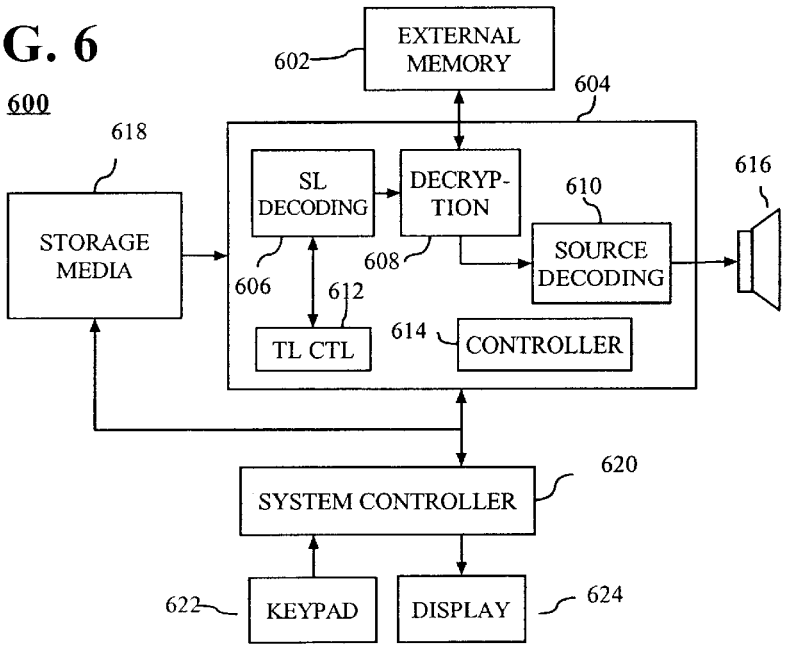
FIG. 6 is a block diagram of a stand alone device with storage media in accordance with the present invention.

Referring to FIG. 6, a block diagram of a stand alone subscriber device 600 is shown in accordance with the present invention. A local storage media 618 contains multiple content segments that have been targeted for storage by the subscriber or user and the associated index information. A system controller 620 is used to select the locally stored content segment using an input selection device such as a keypad 622 for routing to the user via a display 624 or an audio output 616. A source decoder digital signal processor (DSP) 604 enables the access and decoding of the data being accessed. Within the DSP 604, a transport layer controller 612, service layer decoder 606, decryption module 608, source decoder 610 and DSP controller 614 work in conjunction to access external memory 602, and decode and decrypt data for eventual audio replay.

Referring to FIG. 7, a flow chart illustrating a method 700 of receiving and storing digital audio radio signals is shown. At step 702 a digitally encoded bit stream is received over-the-air on a plurality of communication resources, wherein each of the plurality of communication resources contains content and associated index information. Then at step 704 the method proceeds by selectively decoding a selected plurality of the communication resources. At step 706, the selection of the selected plurality of communication resources is enabled by using a user input and the associated index information. At step 708, the method proceeds to store the content and associated index information contained in the selected plurality of communication resources in a memory device. In one alternative aspect of the present invention, if a device that receives and stores digital audio radio signals is receiving a real-time bit stream, then a subscriber or user can have many alternatives in terms of storage and playback. At decision block 709, a user would have the ability to either process the real-time bit stream using real time processing at step 710 or store the content. In another alternative, a method in accordance with the present invention would provide the ability to select a portion of the content contained in the selected plurality of communication resources to be retrieved at step 711 and to optionally retrieve the content or portion thereof for subsequent playback or other processing as described in step 712.

If the method requires security or access privileges to the content, then in another alternative, the authority to retrieve such content can be confirmed at decision block 713 (preferably before actual retrieval) on a selected content by selected content basis as shown with step 714. If the selected content is authorized for retrieval as shown in step 716, then the retrieved content could also be probed for authorization for playback as shown in decision block 618 on a retrieved content by retrieved content basis as indicated by step 720. If the retrieved content is authorized for retrieval and playback, then it is played back at step 722.

What is claimed is:

1. A device for receiving, storing and playing back digital audio radio signals, comprising:

a portable receiver for receiving a digitally encoded bit stream over-the-air on a plurality of communication resources, wherein each of the plurality of communication resources contains content and associated index information;

a decoder for selectively decoding a selected plurality of communication resources;

a user input for selecting the selected plurality of communication resources based on the associated index information and for selecting a portion of the content contained in selected plurality of communication resources to be retrieved;

a storage medium coupled to the decoder for storing the content and associated index information contained in the selected plurality of communication resources;

a system controller coupled to the user input for storing and retrieving content to and from the storage medium based on input received at the user input;

a radio frequency to audio converter module coupled to an audio output device to access content in the plurality of communication resources in real time; and a radio frequency to control data module to provide the system controller with control data that is required to control a signal demultiplexer block to select either real time content or locally stored content for routing to a user.

2. The device of claim 1, wherein the content in the plurality of communication resources is transmitted from a satellite digital audio radio service and is selected from the group comprising music, talk shows, news shows, weather information, traffic information, transportation scheduling information, stock information, or sports information.

3. The device of claim 1, wherein the decoder further comprises a decryption module for decrypting encrypted content.

4. A method of receiving and storing digital audio radio signals, comprising the steps of:

receiving a digitally encoded bit stream over-the-air on a plurality of communication resources, wherein each of the plurality of communication resources contains content and associated index information and one or more of the plurality of communication resources can be grouped to form a higher bit rate payload channel;

selectively decoding a selected plurality of communication resources;

enabling the selection of the selected plurality of communication resources using a user input and the associated index information; and storing the content and associated index information contained in the selected plurality of communication resources in a memory device.

5. The method of claim 4, wherein the method further comprises the step of selecting using the user input a portion of the content contained in the selected plurality of communication resources to be retrieved.

6. The method of claim 5, wherein the method further comprises the step of retrieving the content contained the selected plurality of communication resources.

7. The method of claim 6, wherein the method further comprises the step of playing back the content retrieved.

8. The method of claim 6, wherein the step of retrieving only retrieves a portion that is authorized for retrieval in the content contained in the selected plurality of communication resources.

9. The method of claim 7, wherein the step of playing back only outputs a portion that is authorized for play hack from the content contained in the selected plurality of communication resources.

10. The method of claim 4, wherein the method further comprises the step of selectively playing back portions of the digitally encoded bit stream in real time or playing back selected content from the selected plurality of communication resources stored in the memory device.

11. A system for transmitting, receiving, storing and playing back digital audio radio signals, comprising:

an encoder for encoding a plurality of content sources and associated index information in a digitally encoded bit stream forming the digital audio radio signals;

a transmitter for transmitting over-the-air the plurality of content sources on a corresponding plurality of communication resources;

a portable receiver for receiving the digitally encoded bit stream over-the-air on the plurality of communication resources;

a decoder for selectively decoding a selected plurality of communication resources;

a user input for selecting the selected plurality of communication resources based on the associated index information and for selecting a portion of the content contained in selected plurality of communication resources to be retrieved;

a storage medium coupled to the decoder for storing the content and associated index information contained in the selected plurality of communication resources; and a system controller coupled to the user input for storing and retrieving content to and from the storage medium based on input received at the user input.

12. The system of claim 11, wherein the content in the plurality of communication resources is transmitted from a satellite digital audio radio service and is selected from the group comprising music, talk shows, news shows, weather information, traffic information, transportation scheduling information, stock information, or sports information.

13. The system of claim 11, wherein the system further comprises a radio frequency to audio converter module coupled to an audio output device to access content in the plurality of communication resources in real time.

14. The system of claim 13, wherein the system further comprises a radio frequency to control data module to provide the system controller with control data that is required to control a signal demultiplexer block to select either real time content or locally stored content for routing to a user.

15. The system of claim 11, wherein the system further comprises a decryption module for decrypting encrypted content.

16. The system of claim 11, wherein the transmitter comprises a plurality of satellite and terrestrial transmitters in a satellite digital audio radio system.

* * * * *